US010165663B2

(12) United States Patent
Wiedmann et al.

(10) Patent No.: US 10,165,663 B2
(45) Date of Patent: Dec. 25, 2018

(54) X-RAY SYSTEMS HAVING INDIVIDUALLY MEASURABLE EMITTERS

(71) Applicant: General Electric Company, Schenectady, NY (US)

(72) Inventors: Uwe Wiedmann, Niskayuna, NY (US); Philippe Ernest, Buc (FR); Denis Perrillat-Amede, Buc (FR); Dominique Poincloux, Buc (FR); Jean-Francois Larroux, Buc (FR)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 178 days.

(21) Appl. No.: 15/090,852

(22) Filed: Apr. 5, 2016

(65) Prior Publication Data

US 2017/0290136 A1 Oct. 5, 2017

(51) Int. Cl.

| | |
|---|---|
| ***H05G 1/70*** | (2006.01) |
| ***H05G 1/34*** | (2006.01) |
| ***H05G 1/26*** | (2006.01) |
| ***H05G 1/10*** | (2006.01) |

(52) U.S. Cl.

CPC ..... *H05G 1/265* (2013.01); *H05G 1/10* (2013.01); *H05G 1/34* (2013.01); *H05G 1/70* (2013.01)

(58) Field of Classification Search

CPC .... G01R 19/0092; G01R 1/203; H05G 1/265; H05G 1/10; H05G 1/34; H05G 1/70

USPC ..... 378/101–112

See application file for complete search history.

(56) References Cited

U.S. PATENT DOCUMENTS

| | | | | |
|---|---|---|---|---|
| 2,446,387 | A | 8/1948 | Peterson | |
| 3,450,880 | A * | 6/1969 | Mook | H05G 1/70 315/106 |
| 3,878,455 | A | 4/1975 | Ochmann | |
| 4,177,406 | A | 12/1979 | Hermeyer et al. | |
| 4,322,797 | A | 3/1982 | Lickel et al. | |

(Continued)

FOREIGN PATENT DOCUMENTS

| | | | |
|---|---|---|---|
| DE | 85 26 448 | U1 | 11/1985 |
| JP | S57-202698 | A | 12/1982 |

(Continued)

OTHER PUBLICATIONS

Barnett, M., "Safe control [X-ray tubes]", Power Engineer, vol. 19, Issue: 2, p. 39, Apr. 2005.

(Continued)

*Primary Examiner* — Courtney Thomas

(74) *Attorney, Agent, or Firm* — GE Global Patent Operation; Pabitra Chakrabarti

(57) ABSTRACT

An x-ray system for simultaneously or concurrently measuring currents of multiple emitters is provided. The x-ray system includes a high voltage direct current (DC) supply configured to supply tube current to the multiple emitters and plural emitter circuits. Each of these circuits includes each comprising an alternating current (AC) voltage supply, at least one of the multiple emitters operatively coupled to the AC voltage supply and the high voltage DC supply, and a circuit coupling the AC voltage supply and the high voltage DC voltage supply to the at least one of the multiple filaments. At least one of the emitter circuits has a current measurement device between the high voltage DC supply and the emitter.

21 Claims, 14 Drawing Sheets

(56) References Cited

U.S. PATENT DOCUMENTS

| | | | | |
|---|---|---|---|---|
| 4,684,766 | A | 8/1987 | Tanaka et al. | |
| 4,930,146 | A | 5/1990 | Flakas et al. | |
| 5,077,773 | A | 12/1991 | Sammon | |
| 5,272,618 | A | 12/1993 | Blake | |
| 5,333,169 | A | 7/1994 | Koertge | |
| 7,023,960 | B2 | 4/2006 | Chretien | |
| 7,110,499 | B2 | 9/2006 | Beyerlein et al. | |
| 2012/0190233 | A1 | 7/2012 | Tang et al. | |
| 2013/0315378 | A1 | 11/2013 | Yabugami | |
| 2015/0137795 | A1 | 5/2015 | Wiedmann et al. | |
| 2015/0216025 | A1* | 7/2015 | Jeong | H01J 29/98 378/92 |

FOREIGN PATENT DOCUMENTS

| | | | |
|---|---|---|---|
| JP | H09-161990 | A | 6/1997 |
| JP | H10-189286 | A | 7/1998 |

OTHER PUBLICATIONS

Partial European Search Report and Opinion issued in connection with corresponding EP Application No. 17162959.5 dated Aug. 16, 2017.

Wiedmann, U., et al., Systems and Methods for Measuring Current With Shielded Conductors, U.S. Appl. No. 61/905,635, filed Nov. 18, 2013.

Extended European Search Report and Opinion issued in connection with corresponding EP Application No. 17162959.5 dated Feb. 1, 2018.

* cited by examiner

X-RAY SYSTEMS HAVING INDIVIDUALLY MEASURABLE EMITTERS

FIELD

The subject matter described herein relates to supplying electric power to x-ray systems and/or measuring the electric power supplied to x-ray systems having multiple filaments.

BACKGROUND

An x-ray system includes a filament that operates as a cathode to emit electrons to an anode target. The filament is heated by application or supply of an electrical current through or to the filament. This current results in electrons being stimulated and ejected from the filament and received at the anode target. When a high voltage is applied between the cathode and the anode, the electrons are accelerated toward the anode target. The electrons that strike the anode target result in x-rays being produced in a manner that is proportional to the current flowing to the filament.

Each x-ray tube of a device that emits x-rays may have several emitters, but each tube may only emit electrons from a single emitter at a time. For example, while one emitter is emitting electrons, the remaining emitters are not active or are not emitting electrons. In order to control the electrons emitted from an emitter, the current from the x-ray emitter that is emitting electrons is measured. This current is measured between the cathode and anode of the emitter, and may only be measured at low voltage potentials (such as potentials that are less than 40 kilovolts (kV)) in some known devices.

The current from the x-ray emitter or emitters in some known x-ray systems are measured collectively. For example, the overall tube current may only be able to measure the total current from the emitters and may not be capable of separately measuring the current from each individual emitter. As a result, the power supplies for known x-ray systems having multiple emitters are unable to control the x-ray emissions from each emitter separately.

BRIEF DESCRIPTION

In one embodiment, an x-ray system for simultaneously or concurrently measuring currents of multiple emitters is provided. The x-ray system includes a high voltage direct current (DC) supply configured to supply tube current to the multiple emitters and plural emitter circuits. Each of these circuits includes each comprising an alternating current (AC) voltage supply, at least one of the multiple emitters operatively coupled to the AC voltage supply and the high voltage DC supply, and a circuit coupling the AC voltage supply and the high voltage DC voltage supply to the at least one of the multiple filaments. At least one of the emitter circuits has a current measurement device between the high voltage DC supply and the emitter.

In one embodiment, a method includes supplying tube current from a high voltage direct current (DC) voltage supply to plural emitter circuits to cause filaments in the filament circuits to generate x-rays, supplying an alternating current (AC) for each of the emitter circuits to cause the filaments in the filament circuits to generate the x-rays, and independently measuring current for the filaments in the emitter circuits through a current measurement device disposed between the high voltage DC supply and the emitter.

In one embodiment, an x-ray system includes one or more alternating current (AC) power supplies configured to supply drive currents, plural filaments configured to receive the drive currents to generate x-rays, and plural current measurement devices coupled with the filaments and with a high voltage supply. The current measurement devices are configured to independently measure tube currents of each of the filaments.

DETAILED DESCRIPTION

Figure 1:
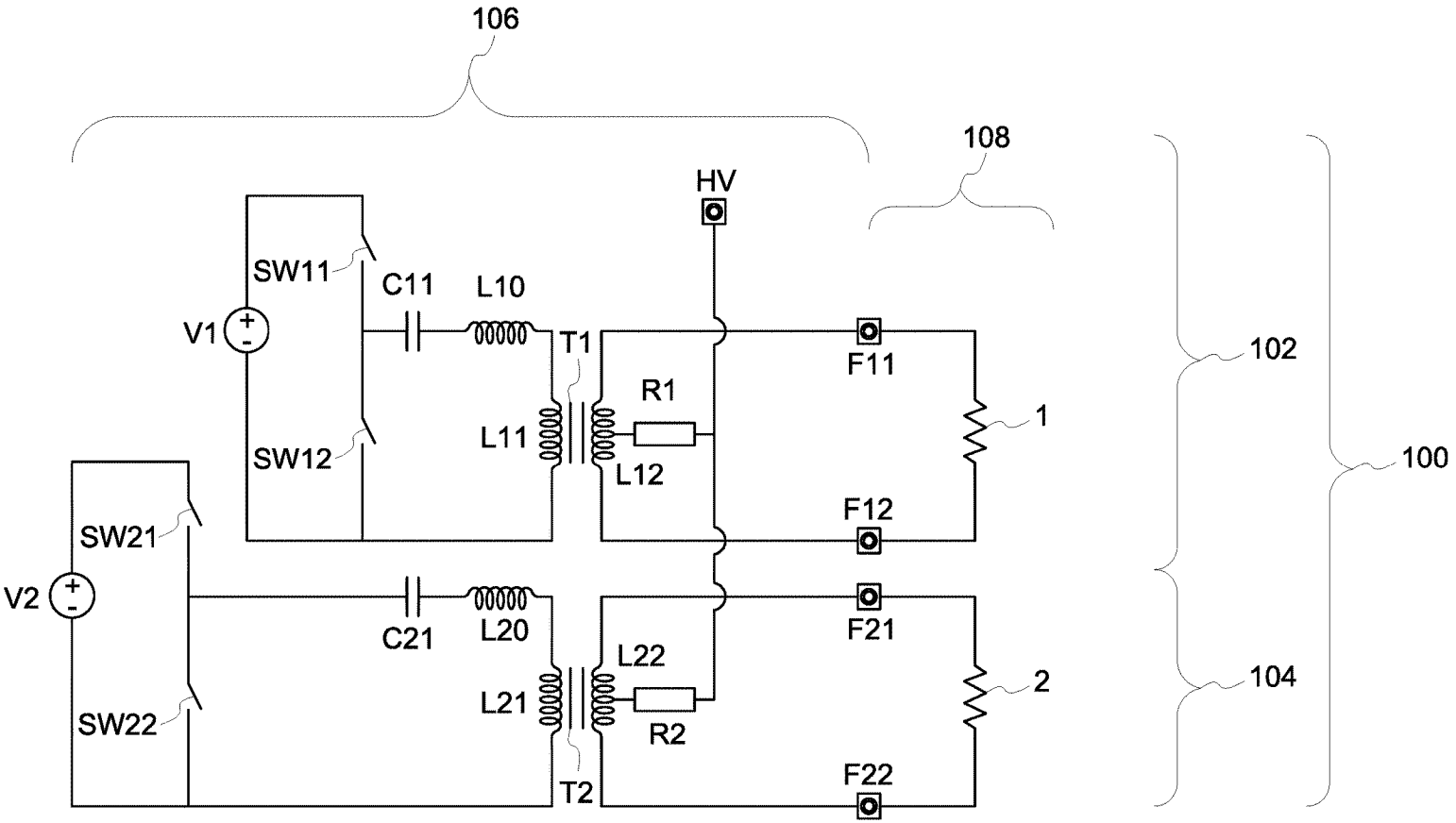
FIG. 1 illustrates one embodiment of an x-ray system having multiple, individually controllable emitters and that can independently measure tube currents.

The inventive subject matter described herein relates to an x-ray system having at least one x-ray tube with multiple individually controllable and/or measurable emitters. The term emitter can refer to a filament that emits charged particles or any other device that emits charged particles in order to generate x-rays. One or more embodiments of an x-ray system can simultaneously or concurrently emit electrons from multiple emitters in the same x-ray tube. The use of multiple emitters at the same time can allow for smaller emitters to be used at the same time (e.g., to concurrently or simultaneously emit electrons) to provide a total tube current that is the sum of the two or more individual emitter currents. The electron beams from the smaller emitters may be easier to focus on a relatively small spot on an x-ray target than a single, larger emitter. Optionally, using multiple emitters to emit electrons at the same time can reduce the wear and tear on the emitters and result in longer useful life spans of the emitters relative to using a smaller number of emitters or a single emitter.

The x-ray system may separately control or regulate the current between the cathode and anode of each emitter in an x-ray tube in order to cause the same amount of x-rays to be generated by each emitter. For example, the emitters may be individually controlled so that the number and/or intensities of the x-rays generated by each emitter are within a designated range of each other, such as 0.01%, 0.1%, 1%, or another threshold range. Individual control of the emitters can involve supplying different amounts of electric current to the cathodes of the emitters while the emitters still generate the same amount of x-rays, even though the emitters may otherwise generate different amounts of x-rays due to differences between the emitters, differences between emitter mountings, different ages of the emitters, or other differences. If the emitters are identical, it can be helpful to have the emitters emit the same amount of x-rays. If, however, the emitters are different (e.g., the emitters have different emitting areas), it can be helpful to have the current emitted by each of the emitters be proportional to the respective emitter areas of the emitters.

In order to separately regulate each emitter, individual measurements are made of the current supplied to each emitter (e.g., to the cathode of each emitter) in order to cause each emitter to emit electrons toward the anode. Because the systems and methods described herein are able to individually measure the current supplied to each emitter cathode, greater voltages may be supplied to each of the emitter cathodes. For example, high voltages of 100 kV or greater may be supplied to each individual emitter cathode. In contrast, because the current supplied to multiple emitter cathodes in known systems cannot be individually controlled to each emitter cathode, the known systems may be limited to dividing the current between the different emitters so that the voltage applied to each emitter is the same or nearly the same (e.g., within 0.1%, within 0.5%, within 1%, or within 4%) as the applied voltage would have been if only a single emitter was used.

FIG. 1 illustrates one embodiment of an x-ray system 100 having multiple, individually controllable emitters 1, 2 and that can independently measure tube currents. As described herein, the emitters 1, 2 (also referred to as filaments 1, 2) are conductively coupled with separate electric emitter circuits 102, 104 that separately conduct electric currents to the emitters 1, 2 to generate x-rays from each of the emitters 1, 2. As shown in FIG. 1, there is no direct electrical or conductive connection between the filaments 1, 2 or the electric emitter circuits 102, 104 that include the filaments 1, 2. This results in the filaments 1, 2 being electrically insulated or isolated from each other. As a result, the x-ray system 100 is able to measure the currents generated by the filaments 1, 2 individually. For example, the current generated by electrons emitted from the cathode of the filament 1 to the anode may be measured separately from but concurrently with the current generated by electrodes emitted from the cathode of the filament 2 to the anode. Additionally, the insulated nature of the filaments 1, 2 allows for the x-ray system 100 to separately provide electric currents to the cathodes of the filaments 1, 2.

The x-ray systems described herein can include interface terminals that represent electrical connections between different portions of the x-ray systems. The x-ray system 100 shown in FIG. 1 includes interface terminals F11, F12, F21, F22 between an x-ray generator 106 and an x-ray tube 108 that includes the filaments 1, 2. The interface terminals can represent conductive connections between the x-ray generate 106 and x-ray tube 106, and may represent one or more wires of a high-voltage cable or other cable between the generator 106 and tube 108. In one embodiment, the number of interface terminals can indicate a number of wires used for cathode operation of the x-ray tube 108. For example, in FIG. 1, interface terminals F11, F12 connect filament 1 of the x-ray tube 108 to a transformer T1 of the x-ray generator 106. Interface terminals F21, F22 connect the filament 2 of the x-ray tube 108 to a transformer T2 of the same x-ray generator 106.

The emitter circuit 102 for the filament 1 includes a direct current (DC) voltage or power source V1 that may be coupled to a primary winding L11 of the transformer T1 through a capacitor C11 and inductor L10. Optionally, one or more additional components or one or more fewer components may be disposed between the voltage source V1 and the transformer T1. The voltage source V1 is used to generate an AC current through operation of switches SW11, SW12 and the primary winding L11 of the transformer T1. The filament 1 may be connected to a secondary winding L12 of the transformer T1 at the interface terminals F11 and F12.

A current measuring device or sensor R1 is connected to the secondary winding L12 of transformer T1 and to a direct current (DC) high voltage source HV of the x-ray generator 106. The voltage source HV may provide larger voltages to the filaments 1, 2 than the voltage sources V1, V2. The device R1 can represent a resistor for the current that is conducted from the high-voltage source HV to the filament F1. A current measurement taken by or through the resistor R1 provides an individual measurement of the current emitted from the filament F1. This current may be regulated or otherwise controlled through circuitry (not shown) to achieve desired or designated electron emissions from the filament F1.

In one embodiment, this circuitry may include a shield for capacitive current as disclosed in U.S. patent application Ser. No. 14/095,724, titled "Systems And Methods For Measuring Current With Shielded Conductors," filed in 3 Dec. 2013, the entire disclosure of which is incorporated herein by reference (referred to herein as the "'724 Application"). The high-voltage source HV can be used to provide shielding of capacitive current in the x-ray system 100. For example, the high voltage source HV can include or be connected with the emitter circuits 102, 104 using one or more shielded wires that keep or maintain a shield at a potential that is close to the potential of the wire(s) that are surrounded by the shield, as described in the '724 Application.

The current supplied to the filament 1 from the high-voltage source HV may be measured as the tube current that is responsible for generating x-rays from the filament 1. Source V1 is a DC source but is used as an AC source by alternatively opening and closing the switches SW11, SW12. The AC generated by the source V1 and the switches SW11, SW12 can be measured with a current measuring device or resistor in series between the capacitor C11 and the inductor L10. This current then is conducted through the inductor L11 to heat the filament 1. The high voltage source HV is a DC that is conducted through the filaments 1, 2. The source V2 can generate an AC in a similar manner as the source V1.

The emitter circuit 104 provides cathode current for the filament 2 and may be symmetric to the emitter circuit 102 that provides cathode current for the filament 1. For filament 2, the separate emitter circuit 104 includes a DC voltage source V2 that may be coupled to a primary winding L21 of a transformer T2 through a capacitor C21 and an inductor L20. Optionally, one or more additional or fewer components may be included in the emitter circuit 104. The DC voltage source V2 generates an AC current through operation of switches SW21, SW22 and the primary winding L21 of the transformer T2.

The filament 2 may be connected to a secondary winding L22 of the transformer T2 through the interface terminals F21 and F22. A current measuring device or sensor R2 is connected to the secondary winding L22 of the transformer T2 and to the DC high voltage source HV. The device R2 can represent a resistor for the individual measurement of current that is emitted from the filament 2. A shield for capacitive current optionally may be included in the emitter circuit 104, similar to as described above in connection with the emitter circuit 102.

The resistors R1, R2 may be connected to the center of the secondary windings L12, L22 of the transformers T1, T2 to create a symmetric coupling between the tube currents from the high voltage source HV to the filaments 1, 2. The symmetric coupling enables the filaments 1, 2 to heat evenly, thereby providing consistent emissions of electrons from the filaments 1, 2 to the anode target and hence a consistent emission of x-rays from the x-ray system 100.

The x-ray system 100 using simultaneous or concurrent emissions from multiple emitters 1, 2 has several advantages compared to systems that employ multiple emitters configured to alternatively emit electrons. Embodiments may be created wherein the emitters are smaller and the electron beams from the smaller emitters are easier to focus to a relatively small spot on the target than a beam from a single larger emitter. The simultaneous use of multiple emitters can also lead to a longer overall emitter life than if the emitters were used alternatively. The sum of the currents used by the multiple emitters together provides the total tube current. By measuring the current emitted from each emitter, it is possible to regulate the emission from each emitter individually and obtain same emission from each emitter or to obtain different emissions from the emitters, as described above. Differences in emitter mounting, emitter aging or other factors can be accounted for regulating emission for the multiple emitters separately based on their individual currents. Conventional tube current measurement schemes operate at low-voltage potentials and can only measure the overall tube current and are not capable of measuring individual currents of the emitters. The x-ray system 100 may measure individual tube current for each emitter 1, 2 at high-voltage potentials.

Figure 2:
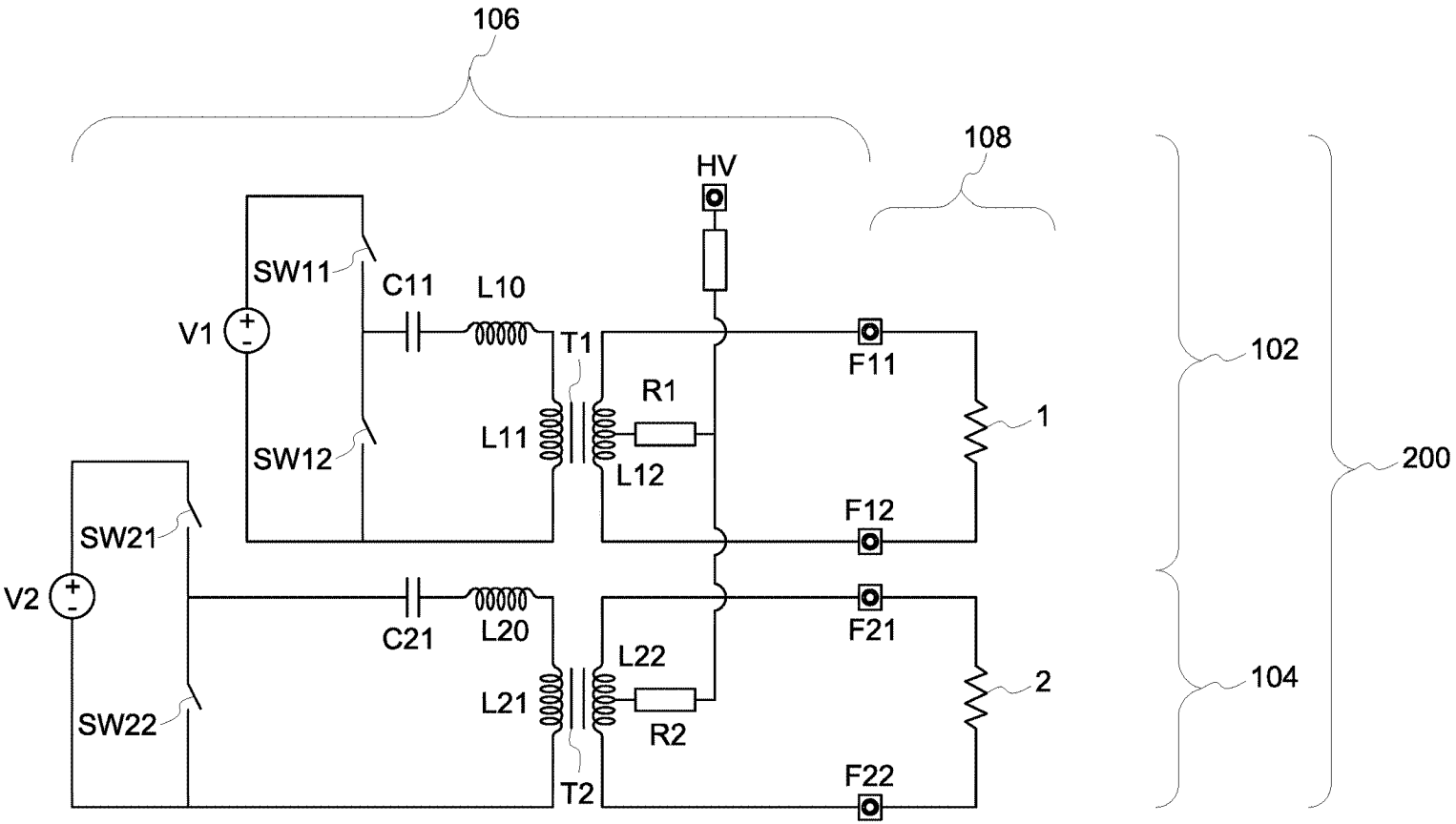
FIG. 2 illustrates another embodiment of an x-ray system having multiple, individually controllable emitters and that can independently measure tube currents.

FIG. 2 illustrates another embodiment of an x-ray system 200 having multiple, individually controllable emitters 1, 2 and that can independently measure tube currents. The x-ray system 200 includes the x-ray generator 106 and the x-ray tube 108 of the x-ray system 100 shown in FIG. 1, as well as the emitter circuits 102, 104 shown in FIG. 1. Similar to as described above in connection with the x-ray system 100, the high-voltage source HV can be used to provide shielding of capacitive current in the x-ray system 200. For example, the high voltage source HV can include or be connected with the emitter circuits 102, 104 using one or more shielded wires that keep or maintain the shield surrounding the wire(s) at a potential that is close to the potential of the wire(s), as described in the '724 Application.

One difference between the x-ray systems 100, 200 is the addition of a measuring device or sensor R3. The device R3 can represent a resistor similar to the devices R1, R2. The device R3 measures the total current that is provided to both filaments F1, F2. For example, in contrast to the device R1 that measures the current provided to the filament 1 and the device R2 that measures the current provided to the filament 2, the device R3 measures the total current supplied to the filaments 1, 2. The measurements provided by the device R3 can provide redundancy in measurements, which may be used to improve radiation safety.

Figure 3:
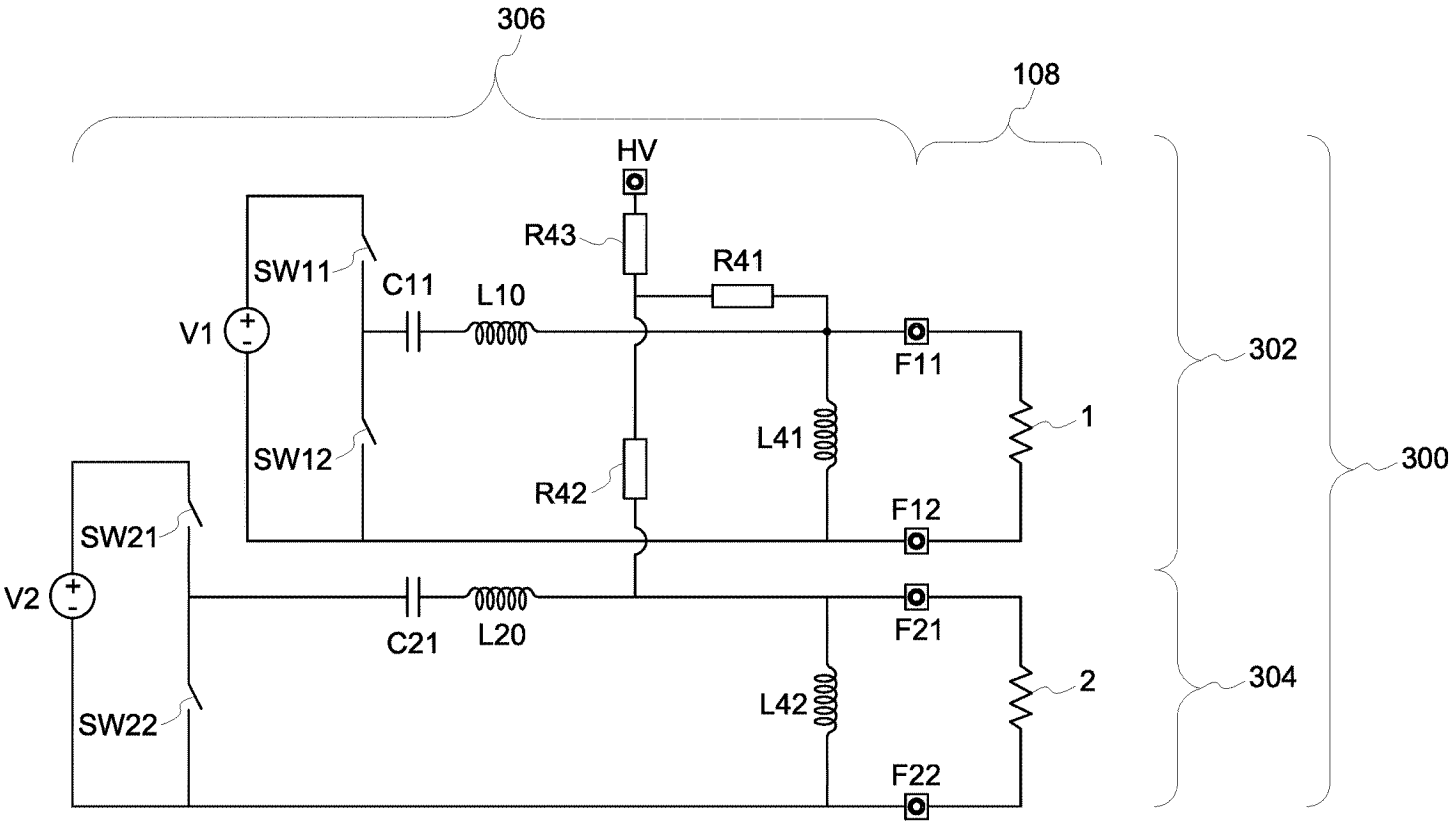
FIG. 3 illustrates another embodiment of an x-ray system having multiple, individually controllable emitters and that can independently measure tube currents.

FIG. 3 illustrates another embodiment of an x-ray system 300 having multiple, individually controllable emitters 1, 2 and that can independently measure tube currents. The x-ray system 300 includes an x-ray generator 306 connected with the x-ray tube 108 described above. Separate electric emitter circuits 302, 304 conduct electric cathode currents from the power sources V1, V2, HV to the filaments 1, 2. As in the x-ray systems 100, 200, the filaments 1, 2 are electrically insulated or separate from each other in the x-ray system 300, thus providing a system 300 that can individually measure tube currents.

One difference between the x-ray system 300 and the x-ray systems 100, 200 is the inclusion of inductors L41, L42 and the exclusion of the transformers T1, T2. As shown in FIG. 3, due to the absence of the transformers in the x-ray system 300, the power sources V1, V2 may be conductively coupled with the filaments 1, 2. The inductors L41, L42 are connected in parallel with the filament 1, 2 in the respective emitter circuit 302, 304. This arrangement of electric emitter circuits 302, 304 provides a nearly symmetric or symmetric coupling of the tube current to filaments 1, 2. The separate emitter circuits 302, 304 in the x-ray system 300 provide cathode currents to the filaments 1, 2 with inductors L41, L42 that are larger or substantially larger than the inductors L10, L20. For example, inductance values of the inductors L41, L42 may be twenty times greater (or more) than the inductance values of the inductors L10, L20.

The x-ray system 300 includes current measurement devices or sensors R41, R42, which may be the same as the devices or sensors R1, R2, respectively. The current measurement devices described herein can include one or more apparatuses that measure direct and/or alternating current, such as multimeters, volt meters, etc. The devices R41, R42 can represent resistors that measure the electric current supplied to corresponding filaments 1, 2. The device R41 can provide a similar function as the device R1 described above in measuring the cathode current to the filament 1. The device 41 is positioned between high voltage supply HV and the filament 1. The device R42 provides a similar function to the device R2 described above in measuring cathode current supplied to the filament 2. The device R42 is positioned between the high voltage supply HV and the filament 2.

In one embodiment, the high voltage source HV and/or the interface terminal 21 can provide shielding against capacitive current. For example, the high voltage source HV and/or the interface terminal 21 can include or be connected with one or more shielded wires that keep or maintain the shield surrounding the wire(s) at a potential that is close to the potential of the wire(s), as described in the '724 Application.

The low voltage sources V1, V2 may float relative to the high voltage source HV and each other. For example, the low voltage sources V1, V2 may not be connected to the same ground reference as the high voltage source HV or each other in one embodiment.

Figure 4:
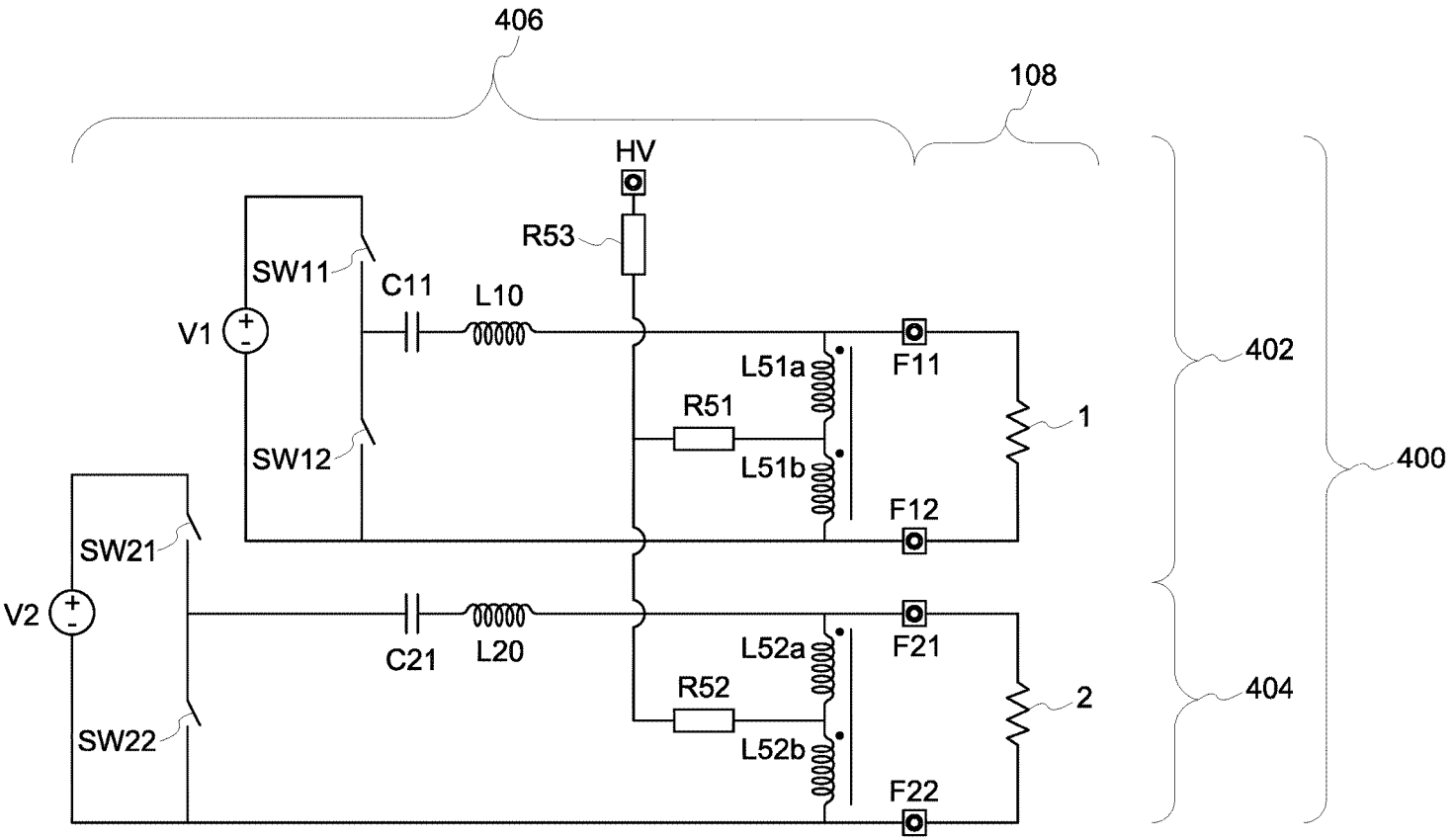
FIG. 4 illustrates another embodiment of an x-ray system having multiple, individually controllable emitters and that can independently measure tube currents.

FIG. 4 illustrates another embodiment of an x-ray system 400 having multiple, individually controllable emitters 1, 2 and that can independently measure tube currents. The x-ray system 400 includes an x-ray generator 406 that is connected to the x-ray tube 108 described above at the interface terminals F11, F12, F21, F22. The x-ray system 400 includes separate electrical emitter circuits 402, 404 to supply cathode currents to the multiple filaments 1, 2 of the x-ray tube 108. In one embodiment, the interface terminals F12, F22 are not electrically connected with each other. For example, these terminals F12, F22 may not be conductively coupled with each other.

The x-ray system 400 includes electrically separate (e.g., insulated) emitter circuits 402, 404 that individually supply electric current to the filaments 1, 2 from the power sources V1, V2, HV. The low voltage sources V1, V2 may float relative to the high voltage source HV and each other. For example, the low voltage sources V1, V2 may not be connected to the same ground reference as the high voltage source HV or each other in one embodiment. Similar to as described above in connection with the x-ray system 100, the high-voltage source HV can be used to provide shielding of capacitive current in the x-ray system 200. For example, the high voltage source HV can include or be connected with the emitter circuits 102, 104 using one or more shielded wires that keep or maintain the shield surrounding the wire(s) at a potential that is close to the potential of the wire(s), as described in the '724 Application. Also similar to the x-ray systems 100, 200, 300, the filaments 1, 2 are insulated from each other, thus providing a system 400 that can measure tube currents individually. The x-ray system 400 may not include a transformer, similar to the x-ray system 300.

The emitter circuits 402, 404 of the x-ray system 400 provide a symmetric coupling of the tube current to the filaments 1, 2 through the separate emitter circuits 402, 404. The emitter circuit 402 that provides current to the filament 1 includes an inductor that is split in half as inductors L51*a*, L51*b* in place of the inductor L41 in the x-ray system 300. A measurement device or sensor R51 that measures the current supplied to the filament 1 is connected with the inductors L51*a*, L51*b* in a location that is between the inductors L51*a*, L51*b* and that is between the inductors L51*a*, L51*b* and the high voltage source HV. The device R51 may represent a resistor that measures this current. The inductors L51*a*, L51*b* may have the same inductance values or inductance values that are substantially similar (e.g., within 50%, within 20%, or within 10% of each other). These inductors L51*a*, L51*b* can provide a symmetrical coupling of the tube current to the filament 1, which can result in symmetrical heating of the filament 1. Otherwise, the filament 1 may unevenly heat from one end of the filament 1 relative to the other end of the filament 1. In one embodiment, each of inductors L51*a*, L51*b* is substantially larger than the inductor L10. For example, each of the inductors L51*a*, L51*b* may have an inductance that is 10 times larger (or more) than the inductor L10.

The emitter circuit 404 that provides current to the filament 2 includes an inductor that is split into inductors L52*a*, L52*b* in place of the inductor L42 in the x-ray system 300. A measurement device or sensor R52 that measures the current supplied to the filament 2 is connected with the inductors L52*a*, L52*b* in a location that is between the inductors L52*a*, L52*b* and that is between the inductors L52*a*, L52*b* and the high voltage source HV. The device R52 may represent a resistor that measures this current. The inductors L52*a*, L52*b* may have the same inductance values or inductance values that are substantially similar (e.g., within 50%, within 20%, or within 10% of each other). These inductors L52*a*, L52*b* can provide a symmetrical coupling of the tube current to the filament 2, which can result in symmetrical heating of the filament 2. Otherwise, the filament 2 may unevenly heat from one end of the filament 2 relative to the other end of the filament 2. In one embodiment, each of inductors L52*a*, L52*b* is substantially larger than the inductor L20. For example, each of the inductors L52*a*, L52*b* may have an inductance that is 10 times larger (or more) than the inductor L20.

The measurement devices R51, R52, and R53 provide similar functions to the devices R41, R42, and R43 described above in connection with the x-ray system 300 shown in FIG. 3. The device R51 can measure the cathode current supplied to the filament 1, the device R52 can measure the cathode current supplied to the filament 2, and the device R53 can measure the total tube current measurement supplied to the filaments 1 and 2 in the x-ray tube 108.

Figure 5:
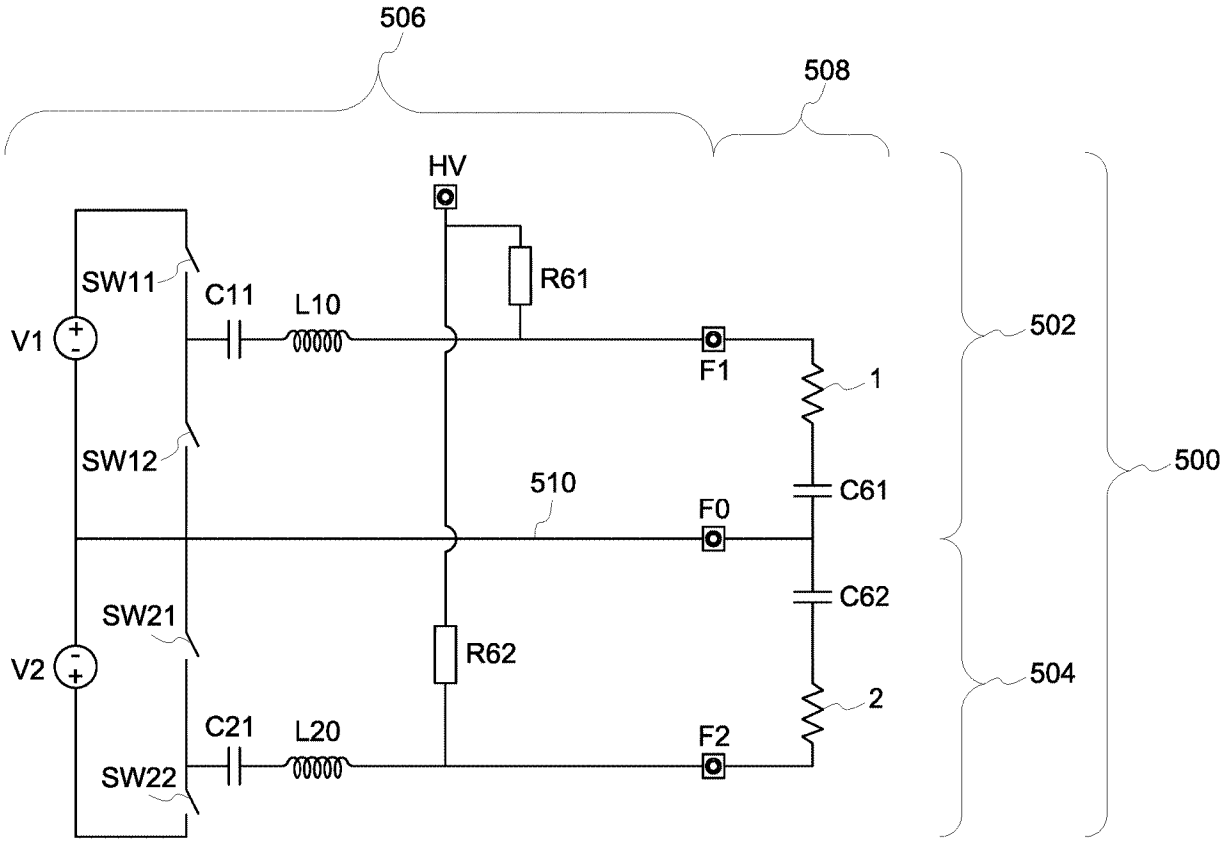
FIG. 5 illustrates another embodiment of an x-ray system having multiple, individually controllable emitters and that can independently measure tube currents.

FIG. 5 illustrates another embodiment of an x-ray system 500 having multiple, individually controllable emitters 1, 2 and that can independently measure tube currents. The system 500 includes emitter circuits 502, 504 that provide separate electric cathode currents to the filaments 1, 2 of an x-ray tube 508 of the x-ray system 500. The system 500 includes an x-ray generator 506 that includes the power sources V1, V2, the switches SW11, SW12, SW 21, SW22, the capacitors C11, C21, and the inductors L10, L11 for supplying low voltage currents to the filaments 1, 2 in an x-ray tube 508 of the x-ray system 500.

Several interface terminals F0, F1, F2 conductively couple the x-ray generator 506 with the x-ray tube 508. One difference between the emitter circuits 502, 504 of the x-ray system 500 and the emitter circuits 102, 104, 302, 304, 402, 404 of the x-ray systems 100, 200, 300, 400 is that the emitter circuits 502, 504 in the x-ray system 500 share a common conductive line 510. The common line 510 is conductively coupled with the power sources V1, V2, the switches SW11, SW12, SW 21, SW22, the capacitors C11, C21, and the inductors L10, L11 in a location that is between the switches 12, 21. The common line 510 also is conductively coupled with the interface terminal F0. The interface terminal F0 is conductively coupled with the filaments 1, 2 in the x-ray tube 508 in a location that is between capacitors C61, C62 of the x-ray tube 508, as shown in FIG. 5. The common line 510 prevents the emitter circuits 502, 504 from being electrically separated or insulated from each other. But, inclusion of the common line 510 can reduce the number of conductive pathways (e.g., wires, traces, or buses) relative to the x-ray systems 100, 200, 300, 400, such as by reducing the number of wires within a high-voltage cable and by reducing the number of high-voltage connections on in the x-ray generator 506 and the x-ray tube 508.

The interface terminal F0 may shield the filaments 1, 2 from capacitive currents conducted within one or more of the emitter circuits 502, 504. A measurement device or sensor R61 is connected with the high voltage power source HV and the conductive line that couples the inductor L10 with the filament 1 in a location between the filament 1 and the high voltage source HV. The device R61 can represent a resistor that provides for individual current measurement of the current conducted to the filament 1 from the high voltage power source HV. A measurement device or sensor R62 is connected with the high voltage power source HV and the conductive line that couples the inductor L20 with the filament 2 in a location between the filament 2 and the high voltage source HV. The device R62 can represent a resistor that provides for individual current measurement of the current conducted to the filament 2 from the high voltage power source HV.

Because the emitter circuits 502, 504 are connected with each other by the conductive line 510, the x-ray system 500 shown in FIG. 5 includes asymmetric coupling of the filaments 1, 2. The capacitors C61, C62 are in series with the filaments 1, 2, and operate as high pass filters between each filament 1, 2 and the interface terminal F0 on the common line 510. The capacitance of each of the capacitors C61, C62 may be substantially larger than the capacitance of each of the capacitors C11, C21. For example, the capacitance of each of the capacitors C61, C62 may be at least ten, twenty, or one hundred times larger than the capacitance of each of the capacitors C11, C21.

The capacitors C61, C62 block the tube currents (the currents generated by electrons emanating from the filaments 1, 2, which are DC currents) from being conducted in the emitter circuits 502, 504 outside of the filaments 1, 2. For example, the capacitors C61, C62 may block low-frequency tube current, but allow high-frequency filament drive current to pass through the capacitors. The tube current may be the current generated by the filaments 1, 2, while the drive current can be the high voltage alternating current supplied to the filaments 1, 2 by the high voltage source HV. By blocking these tube currents, the capacitors C61, C62 can allow for independent tube current measurement, while at the same time allowing AC current to pass back to the low voltage sources V1, V2 through a switching network formed by the switches SW11, SW12, SW21, SW22.

The interface terminal F0 in the x-ray system 500 can be used to provide shielding of capacitive current in the x-ray system 500. For example, the terminal F0 can include or be connected with one or more shielded wires that keep or maintain the shield surrounding the wire(s) at a potential that is close to the potential of the wire(s), as described in the '724 Application. Although the interface terminal F0 is not conductively coupled with the high voltage source HV in the illustrated embodiment, alternatively, the terminal F0 may be conductively coupled with the source HV.

Figure 6:
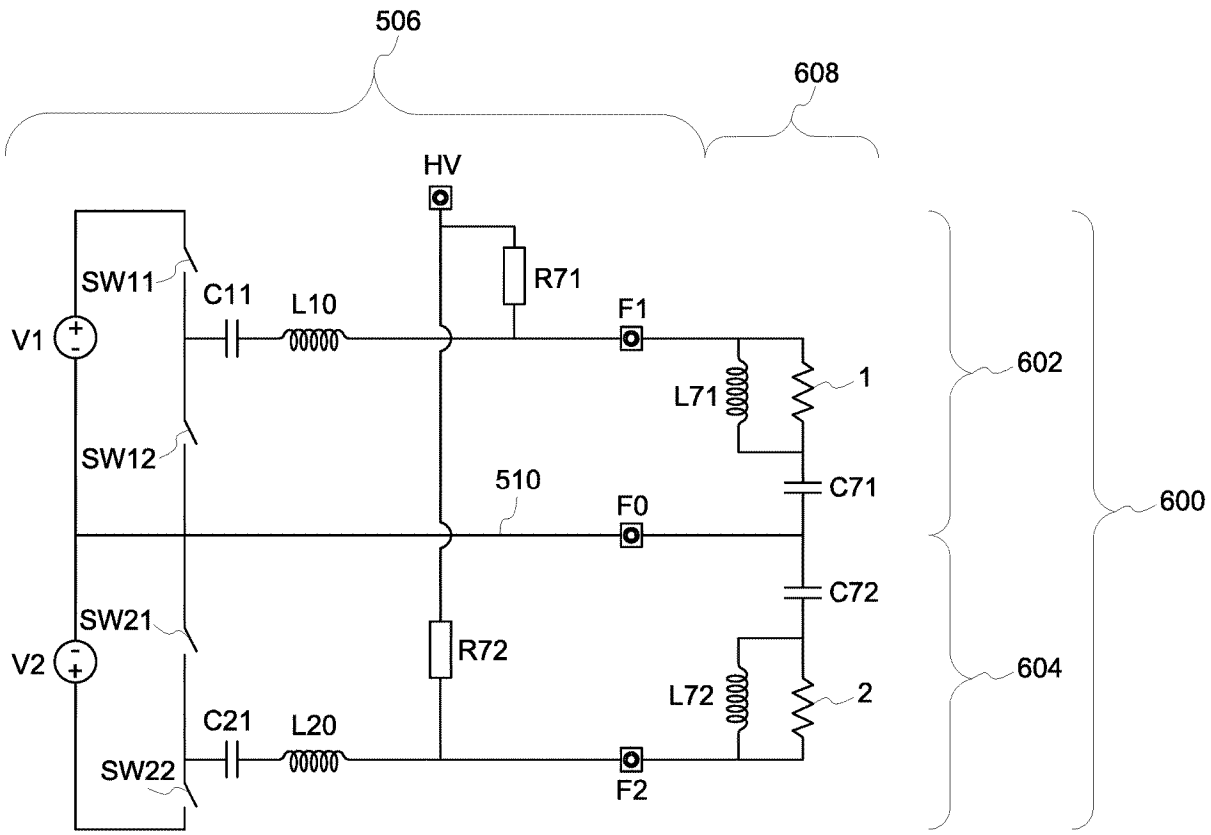
FIG. 6 illustrates another embodiment of an x-ray system having multiple, individually controllable emitters and that can independently measure tube currents.

FIG. 6 illustrates another embodiment of an x-ray system 600 having multiple, individually controllable emitters 1, 2 and that can independently measure tube currents. The x-ray system 600 includes two electric emitter circuits 602, 604 to independently supply and measure currents to the filaments 1, 2 in an x-ray tube 608 of the x-ray system 600. Each of the emitter circuits 602, 604 separately measures the individual tube currents of the filaments 1, 2. The interface terminals F0, F1, F2 connect the x-ray tube 608 with the filaments 1, 2 to an x-ray generator 506. Similar to the x-ray system 500 shown in FIG. 5, the emitter circuits 602, 604 in the x-ray system 600 of FIG. 6 are not completely isolated from each other.

The x-ray system 600 shown in FIG. 6 is similar to the x-ray system 500 shown in FIG. 5. For example, the x-ray systems 500, 600 may include the same x-ray generators 506, filaments 1, 2, high and low voltage sources HV, V1, V2, switches SW11, SW12, SW21, SW22, capacitors C11, C21, and inductors L10, L20. The x-ray system 600 may include measurement devices or sensors R71, R72 that are similar or identical to the devices R61, R62 in the x-ray system 500. The x-ray system 600 also may include capacitors C71, C72 that are similar or identical to the capacitors C61, C62 in the x-ray system 500.

One difference between the x-ray systems 500, 600 is the addition of inductors L71, L72 to the x-ray system 600. The inductor L71 is connected with the filament 1 between the high voltage source HV and the filament 1 and between the filament 1 and the capacitor C71. The inductor L72 is connected with the filament 2 between the high voltage source HV and the filament 2 and between the filament 2 and the capacitor C72. The capacitors C71, C72 may be similar or identical to the capacitors C61, C62 of the x-ray system 500 shown in FIG. 5.

The inductors L71, L72 are arranged in parallel with the respective filaments 1, 2 in the x-ray tube 608 and operate as low pass filters for the current supplied to the filaments 1, 2. In one embodiment, the inductors L71, L72 have inductances that are substantially larger than the inductors L10, L20, respectively. For example, the inductances of each of the inductors L71, L72 may be ten times or twenty times greater than the inductances of each of the inductors L10, L20.

A current measuring device R71 for filament 1 may be similar or identical to the device R61 in the x-ray system 500 in FIG. 5. The device R71 is connected to the high voltage supply HV and the filament 1 in a location between the supply HV and the filament 1. A current measuring device R72 for filament 2 may be similar or identical to the device R62. The device R72 is connected to the high voltage supply HV and the filament 2 in a location between the supply HV and the filament 2.

In operation, the inductors L71, L72 allow low-frequency tube current emitted from the filaments 1, 2 to pass through the inductors L71, L72, but block the high-frequency current supplied to power (e.g., heat) the filaments 1, 2. The capacitors C71, C72 can block the low-frequency tube current generated in the filaments 1, 2, but allow the high-frequency current supplied to power the filaments 1, 2 to pass through the capacitors C71, C72.

The interface terminal F0 in the x-ray system 600 can be used to provide shielding of capacitive current in the x-ray system 600. For example, the terminal F0 can include or be connected with one or more shielded wires that keep or maintain the shield surrounding the wire(s) at a potential that is close to the potential of the wire(s), as described in the '724 Application. Although the interface terminal F0 is not conductively coupled with the high voltage source HV in the illustrated embodiment, alternatively, the terminal F0 may be conductively coupled with the source HV.

Figure 7:
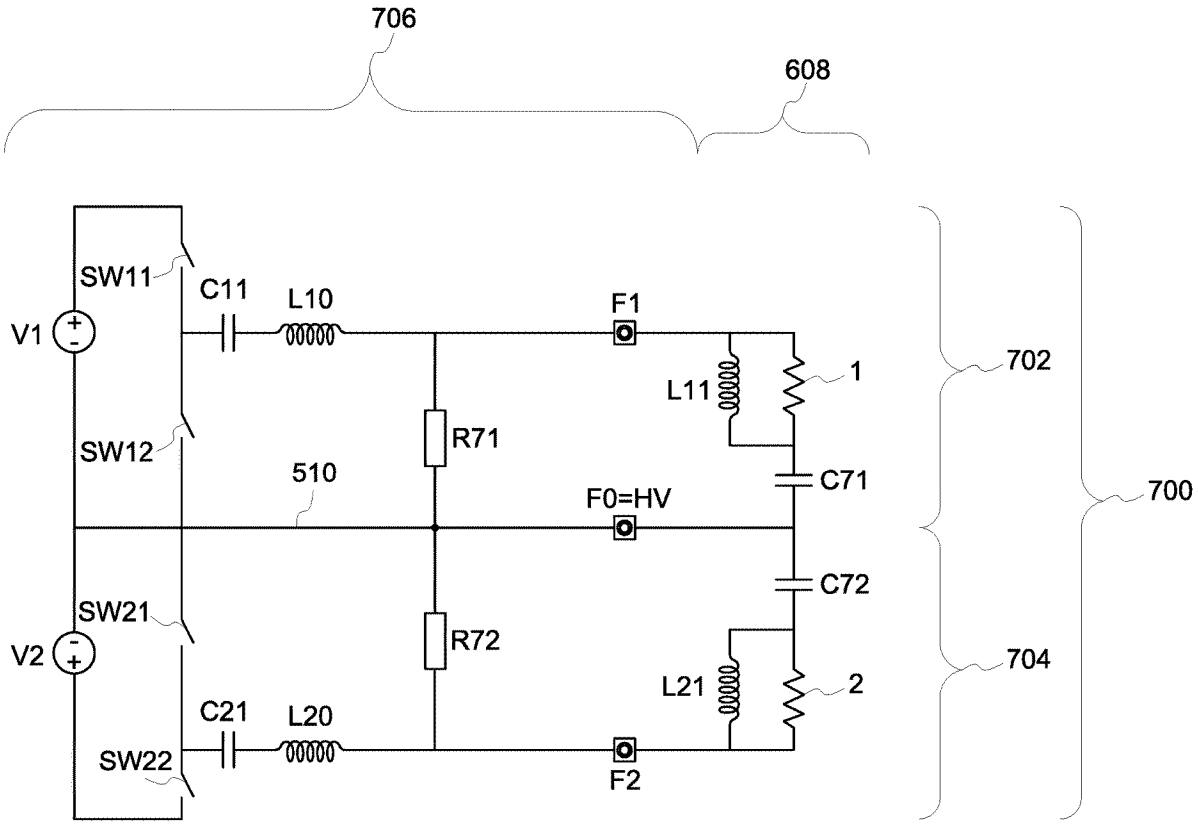
FIG. 7 illustrates another embodiment of an x-ray system having multiple, individually controllable emitters and that can independently measure tube currents.

FIG. 7 illustrates another embodiment of an x-ray system 700 having multiple, individually controllable emitters 1, 2 and that can independently measure tube currents. The x-ray system 700 includes emitter circuits 702, 704 that conduct current from an x-ray generator 706 to the emitters 1, 2 and allows for the tube currents of the emitters 1, 2 to be individually measured. The x-ray system 700 includes several of the components described above in connection with other embodiments of x-ray systems, as shown in FIG. 7.

In contrast to the x-ray system 600, the high voltage supply or source HV is connected with the interface terminal F0 and the common line 510 of the emitter circuits 702, 704 in the x-ray system 700 shown in FIG. 7. While the source HV is connected with the interface terminal F1 via the measuring device R71 and with the interface terminal F2 via the measuring device R72 in the x-ray system 600, the source HV may be directly connected with the interface terminal F0 and not the interfaces F1, F2 in the x-ray system 700.

In the illustrated embodiment, the current measuring devices R71, R72 have high impedances to prevent shorting of the drive currents supplied to the filaments 1, 2. For example, the impedances of the devices R71, R72 in the x-ray system 700 may have impedances that are at least ten to twenty times larger than the impedances of the other components in the x-ray system 700 shown in FIG. 7.

If devices R71, R72 have smaller impedances, a significant portion of the filament drive current conducted through the devices L10, L20 to the filaments 1, 2 is lost, thereby making the tube current measurement less accurate. One or more additional embodiments of x-ray systems described below address these losses and reduce or eliminate these losses.

Figure 8:
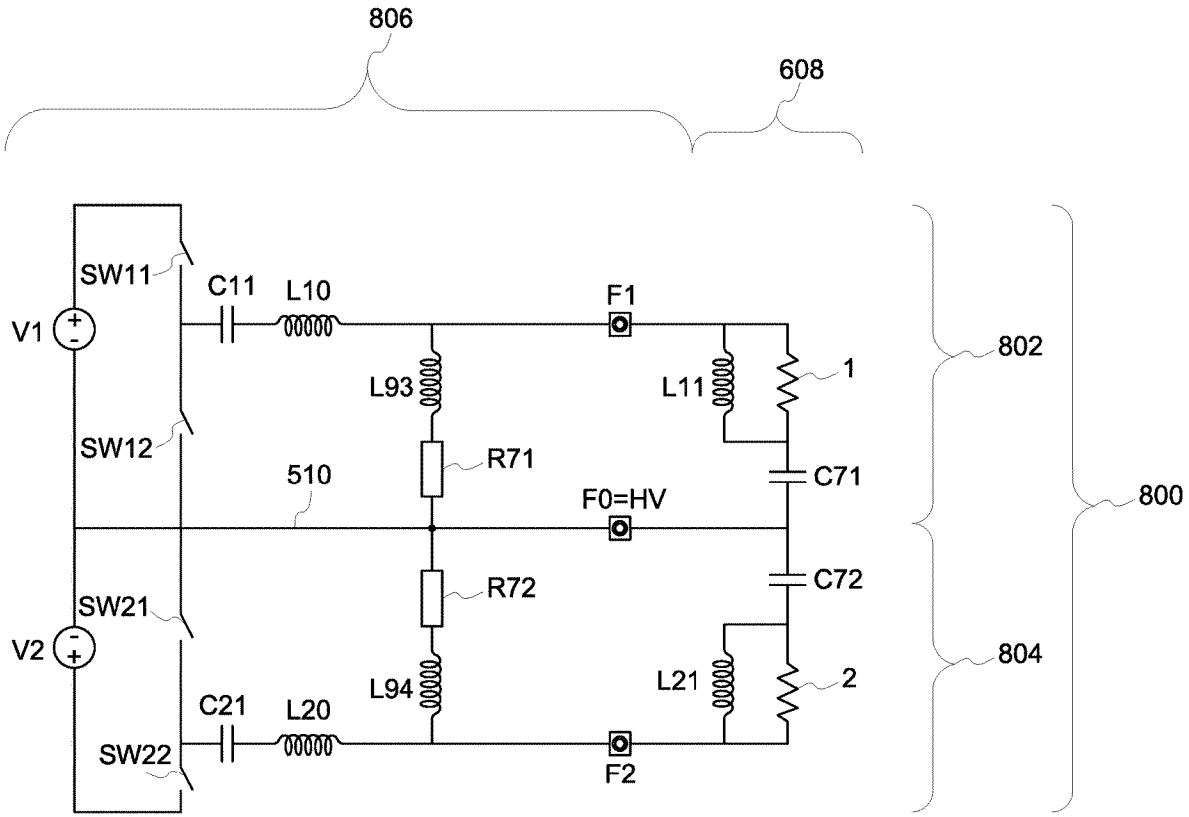
FIG. 8 illustrates another embodiment of an x-ray system having multiple, individually controllable emitters and that can independently measure tube currents.

FIG. 8 illustrates another embodiment of an x-ray system 800 having multiple, individually controllable emitters 1, 2 and that can independently measure tube currents. The x-ray system 800 includes emitter circuits 802, 804 that conduct current from an x-ray generator 806 to the emitters 1, 2 in the x-ray tube 608 and that allows for the tube currents of the emitters 1, 2 to be individually measured. The x-ray system 800 includes several of the components described above in connection with other embodiments of x-ray systems, as shown in FIG. 8.

One difference between the x-ray system 700 shown in FIG. 7 and the x-ray system 800 shown in FIG. 8 is the addition of an inductor L93 in series with the current measurement device R71 and an inductor L94 in series with the current measurement device R72. The inductor L93 and the device R71 are in parallel with the filament 1 and the inductor L94 and the device R72 are in parallel with the filament 2. The inductances of the inductors L11, L93, L21, L94 are substantially larger than the inductances of the inductors L10, L20, such as at least ten times larger, at least twenty times larger, or even larger.

The capacitors C71, C72 operate as high pass filters arranged in series between the cathode of the filament 2 and the interface terminal F0 on the common return line 510. In one embodiment, the capacitances of the capacitors C71, C72 are substantially larger than the capacitances of the capacitors C11, C21, such as by being at least ten times larger, at least twenty times larger, or larger. The x-ray system 800 provides for improved immunity of the tube current measurements at low frequencies to filament drive current at high frequencies. For example, the tube current measurements may be more independent of or orthogonal to the changes in the filament drive current.

Figure 9:
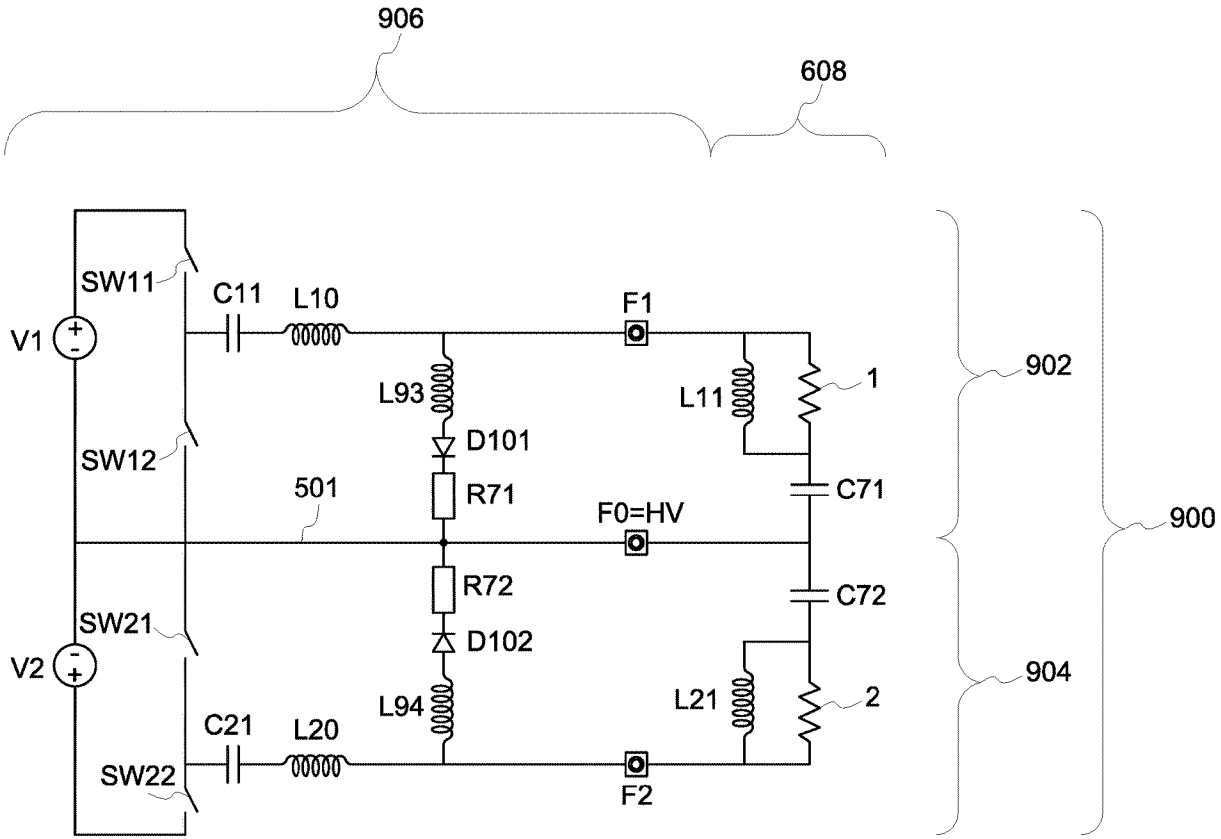
FIG. 9 illustrates another embodiment of an x-ray system having multiple, individually controllable emitters and that can independently measure tube currents.

FIG. 9 illustrates another embodiment of an x-ray system 900 having multiple, individually controllable emitters 1, 2 and that can independently measure tube currents. The x-ray system 900 includes emitter circuits 902, 904 that conduct current from an x-ray generator 906 to the emitters 1, 2 in the x-ray tube 608 and that allows for the tube currents of the emitters 1, 2 to be individually measured. As shown in FIG. 9, the x-ray system 900 includes several of the components described above in connection with other embodiments of x-ray systems.

One difference between the x-ray system 900 shown in FIG. 9 and the x-ray system 800 shown in FIG. 8 is the inclusion of diodes D101, D102 between the inductors L93, L94 and the current measurement devices R71, R72. The diode D101 has an anode that is electrically connected or coupled with the inductor L93 and a cathode that is electrically connected or coupled with the current measurement device R71. The diode D102 has an anode that is electrically connected or coupled with the inductor L94 and a cathode that is electrically connected or coupled with the current measurement device R72.

In one embodiment, the diodes D101, D102 can remove the AC components from the tube currents that are measured by the current measurement devices R71, R72. Additionally, changes in the drive current (e.g., the current supplied to the filaments 1, 2) result in the current measurement devices R71, R72 measuring signal changes in the current that is measured. For example, changes in the drive current to the filament 1 can cause the current measured by the current measurement device R71 to change from a positive value to a negative value, or vice versa.

Figure 10:
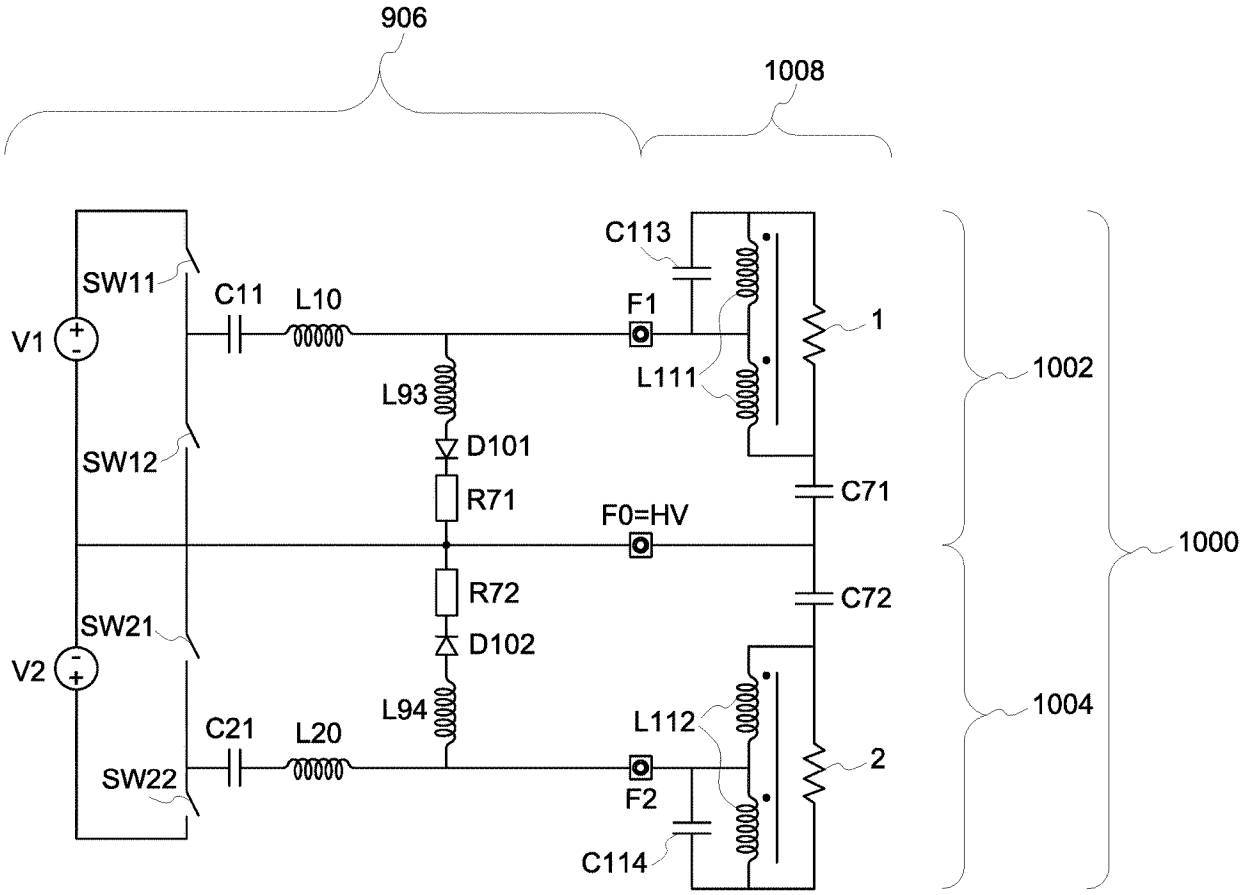
FIG. 10 illustrates another embodiment of an x-ray system having multiple, individually controllable emitters and that can independently measure tube currents.

FIG. 10 illustrates another embodiment of an x-ray system 1000 having multiple, individually controllable emitters 1, 2 and that can independently measure tube currents. The x-ray system 1000 includes emitter circuits 1002, 1004 that conduct current from the x-ray generator 906 (described above in connection with the x-ray system 900) to the emitters 1, 2 in an x-ray tube 1008 and that allows for the tube currents of the emitters 1, 2 to be individually measured. As shown in FIG. 10, the x-ray system 1000 includes several of the components described above in connection with other embodiments of x-ray systems.

One difference between the x-ray system 1000 shown in FIG. 10 and the x-ray system 900 shown in FIG. 9 is the inclusion of a capacitor C113 and inductors L111 connected with the filament 1 and a capacitor C114 and inductors L112 connected with the filament 2. The capacitors C113, C114 and inductors L111, L112 provide for symmetric tube current to be injected into the filaments 1, 2. This symmetric tube current injection is accomplished by the inductors L111, L112 being connected in parallel with the corresponding filaments 1, 2, and the filaments 1, 2 having center taps between the corresponding inductors L111, L112. The symmetric tube current injection includes supplying an even injection of tube current into each side or end of each of the filaments 1, 2. For example, instead of more current being injected into the top end of the filament 1 than the opposite bottom end of the same filament 1, the amount of current injected into each end of the filament 1 may be substantially equivalent.

The capacitors C71, C72, C113, C114 can block conduction of low-frequency tube current, but allow high-frequency filament drive current to be conducted through the capacitors. In one embodiment, the inductors L111 may be a single inductor that is in parallel with the filament 1 and is split in half with the capacitor C113 that is arranged in parallel with the half of the inductor L111 that has a common node with the center tap of the filament 1. The inductor L111 has another common node at a first end of filament 1. The inductor L112 may be a single inductor that is in parallel with the filament 2 and is split in half with the capacitor C114 that is arranged in parallel with the half of the inductor L112 that has a common node with the center tap of the filament 2. The inductor L112 has another common node at a first end of filament 2.

Figure 11:
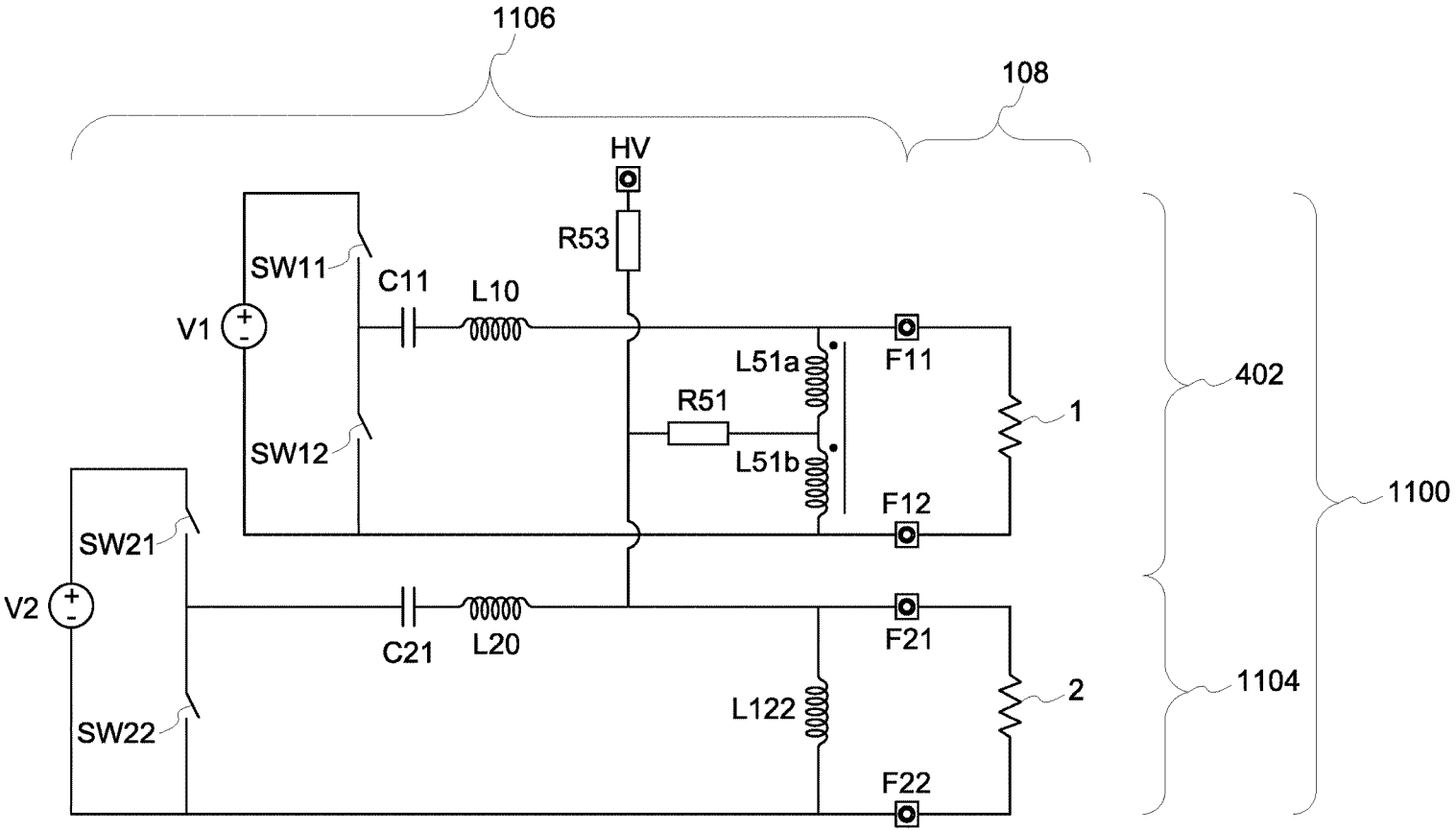
FIG. 11 illustrates another embodiment of an x-ray system having multiple, individually controllable emitters and that can independently measure tube currents.

FIG. 11 illustrates another embodiment of an x-ray system 1100 having multiple, individually controllable emitters 1, 2 and that can independently measure tube currents. The x-ray system 1100 includes an x-ray generator 1106 that is connected to the x-ray tube 108 described above at the interface terminals F11, F12, F21, F22. The x-ray system 1100 includes separate emitter circuits 402, 1104 to supply cathode currents to the multiple filaments 1, 2 of the x-ray tube 108. Many of the components and emitter circuit 402 of the x-ray system 1100 are described above in connection with FIG. 4. In one embodiment, one or more of the high voltage source HV and/or the terminal 21 may provide shielding of capacitive current, as described above.

One difference between the x-ray systems 400, 1100 is that, while the inductor in the system 400 is split into the inductors L52*a*, L52*b*, the system 1100 may include an inductor L122 that is not split or divided into smaller inductors. The inductor L122 may have an inductance that is at least twenty times larger than the inductance of the inductor L20 in the same emitter circuit 1104. Each of the inductors L51*a*, L51*b* may have an inductance that is at least ten times the inductance of the inductor L10 in the same emitter circuit 402.

The measurement device R51 may be connected on one side to the high voltage source HV and on the other side to a center node between the inductors L51*a* and L51*b*. The measurement device R53 may be connected in series with the high voltage source HV in order to measure the total current supplied by the source HV. A control system (described below) can determine the tube current in the filament 2 by subtracting the current measured by the device R51 from the current measured by the device R53. The system 1100 provides electrically separate or insulated emitter circuits 402, 1104 without a transformer disposed in the system 1100. The system 1100 provides a nearly symmetric coupling of the tube current to the filaments 1, 2.

Figure 12:
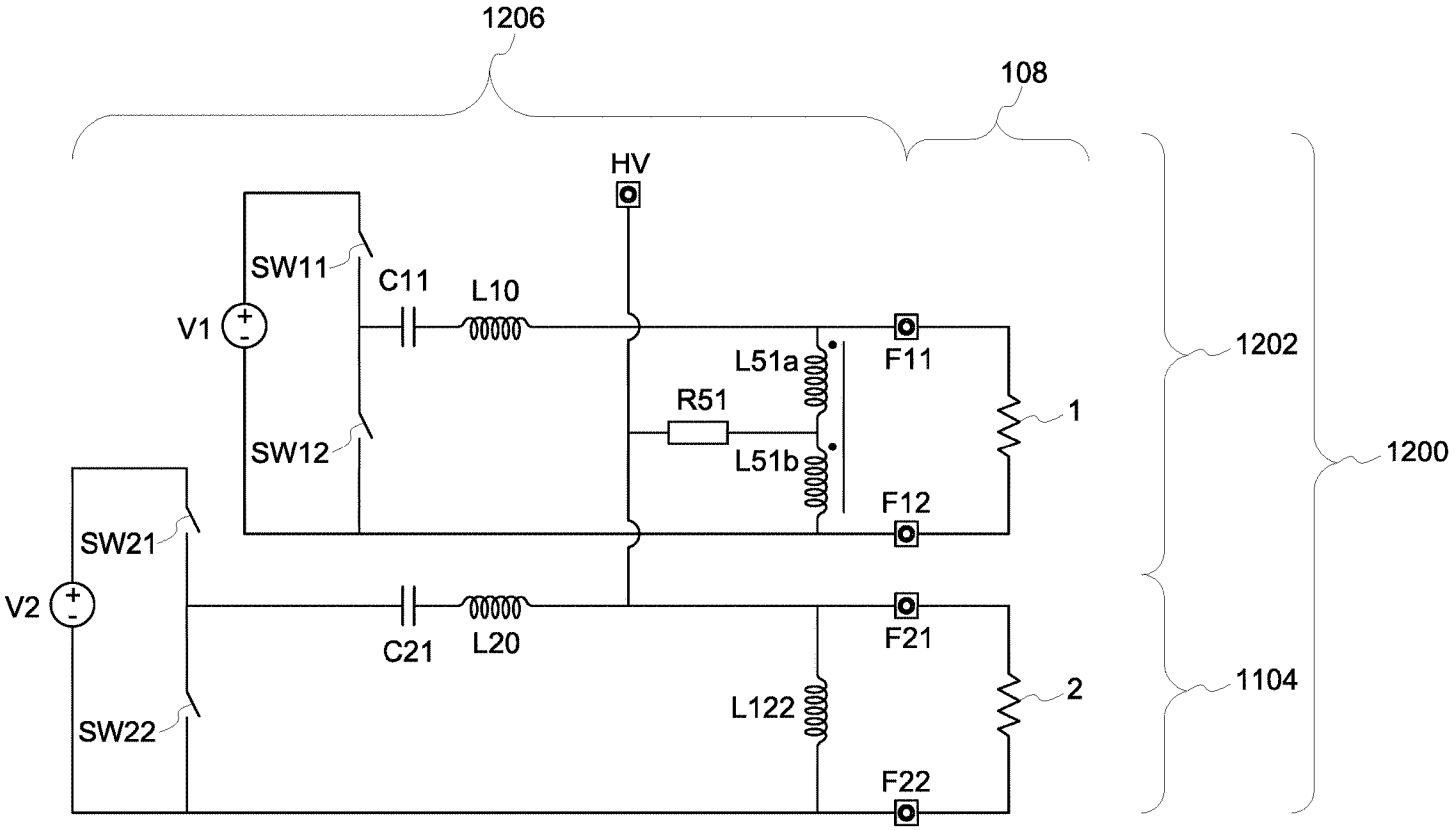
FIG. 12 illustrates another embodiment of an x-ray system having multiple, individually controllable emitters and that can independently measure tube currents.

FIG. 12 illustrates another embodiment of an x-ray system 1200 having multiple, individually controllable emitters 1, 2 and that can independently measure tube currents. The x-ray system 1200 includes an x-ray generator 1206 that is connected to the x-ray tube 108 described above at the interface terminals F11, F12, F21, F22. The x-ray system 1200 includes separate electrical emitter circuits 1202, 1104 to supply cathode currents to the multiple filaments 1, 2 of the x-ray tube 108. Many of the components and emitter circuit 1104 of the x-ray system 1200 are described above in connection with FIG. 12. In one embodiment, one or more of the high voltage source HV and/or the terminal 21 may provide shielding of capacitive current, as described above. The system 1200 provides electrically separate or insulated emitter circuits 1202, 1104 without a transformer disposed in the system 1200. The system 1200 provides a nearly symmetric coupling of the tube current to the filaments 1, 2.

The emitter circuit 1202 that supplies filament 1 with current has the inductors L51*a*, L51*b* in series with each other such that the inductors L51*a*, L51*b* are in parallel with the filament 1. The inductors L51*a*, L51*b* may be a single inductor that is split in half at a center tap. The measurement device R51 can be attached on one side to the high voltage source HV and on the other side to the center tap between the inductors L51*a* and L51*b*. The inductor L122 may be in parallel with the filament 2, and may have an inductance that is twice or at least twice the inductance of the inductor L51*a* or the inductor L51*b*. The current in filament 2 can be determined by measuring the overall tube current of both filaments 1, 2 at low voltages, measuring the tube current at high voltage for the filament 1 using the measurement device R51, and calculating the difference between these measured currents.

Figure 13:
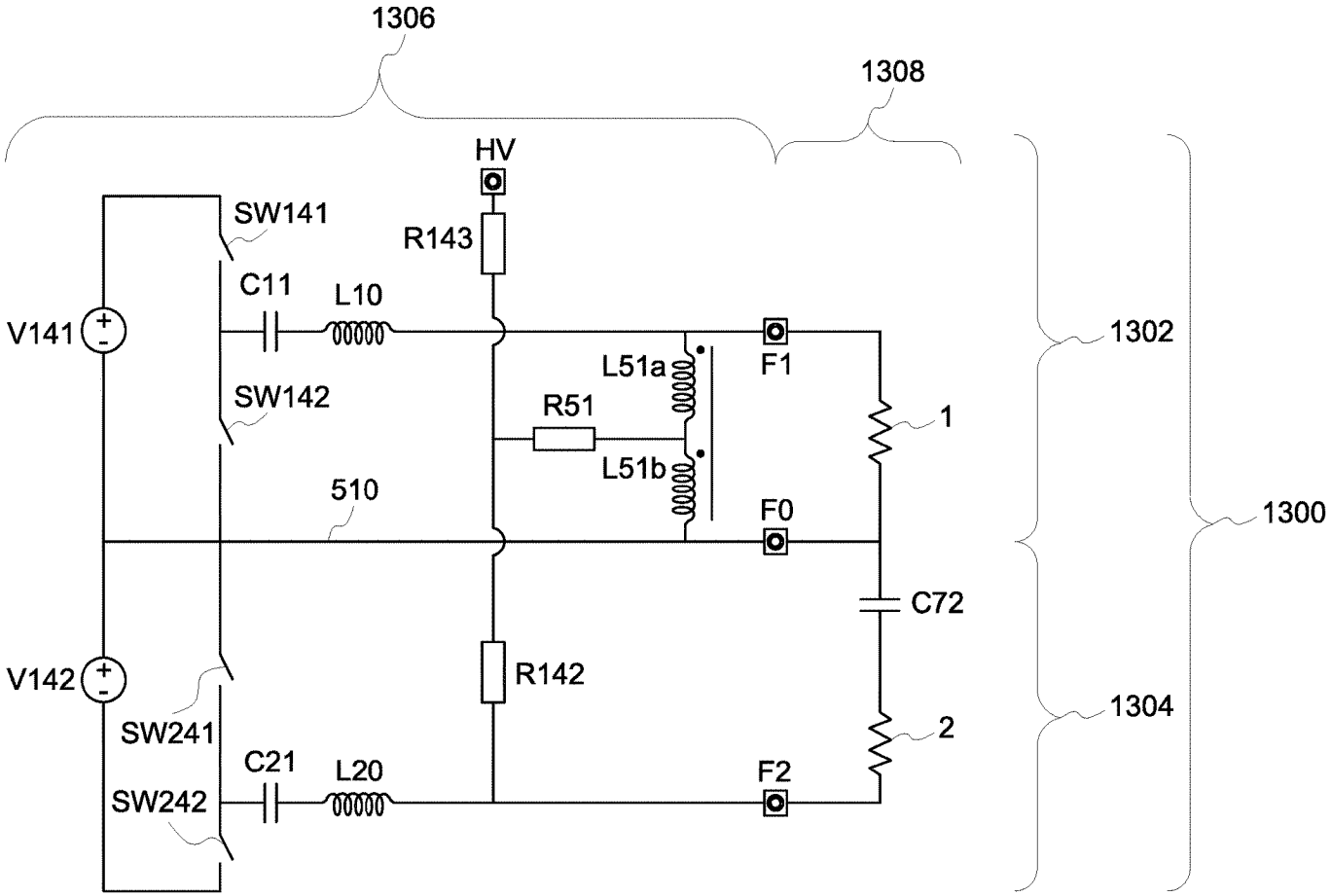
FIG. 13 illustrates another embodiment of an x-ray system having multiple, individually controllable emitters and that can independently measure tube currents.

FIG. 13 illustrates another embodiment of an x-ray system 1300 having multiple, individually controllable emitters 1, 2 and that can independently measure tube currents. The x-ray system 1300 includes an x-ray generator 1306 that is connected to an x-ray tube 1308 at the interface terminals F0, F1, F2. The x-ray system 1300 includes electric emitter circuits 1302, 1304 to supply cathode currents to the multiple filaments 1, 2 of the x-ray tube 1308. Many of the components of the x-ray system 1300 are described above. The emitter circuits 1302, 1304 are connected and share the common return line 510 that is connected to the interface terminal F0.

The system 1300 includes several current measurement devices R143, R51, R142. The device R143 can measure the total current supplied from the high voltage source HV to both filaments 1, 2. The device R51 can measure the current supplied to the filament 1 and the device R142 can measure the current supplied to the filament 2. These measurements can be used as redundant measurements of the tube current of the filaments 1, 2. For example, the current measured by the device R51 can be subtracted from the total current measured by the device R143 to check or verify the current measured by the device R142, the current measured by the device R142 can be subtracted from the total current measured by the device R143 to check or verify the current measured by the device R51, and/or the current measured by the device R51 and the current measured by the device R142 can be added together to check or verify the total current measured by the device R143.

Figure 14:
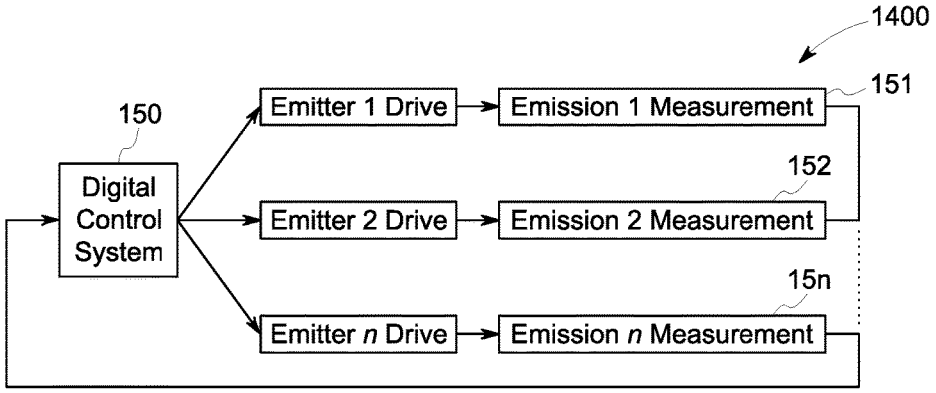
FIG. 14 illustrates an x-ray control system according to one embodiment.

FIG. 14 illustrates an x-ray control system 1400 according to one embodiment. The x-ray control system 1400 may include a controller 150 ("Digital Control System" in FIG. 14) having hardware circuitry that includes and/or is connected with one or more processors (e.g., microprocessors, integrated circuits, and/or field programmable gate arrays) that are programmed or operate based on programming to perform the operations described herein. The controller 150 can communicate with the current measurement devices, high voltage sources, and/or the low voltage sources described herein to control and monitor operation of one or more embodiments of the x-ray systems described herein. The controller 150 can communicate with the devices and/or sources via one or more wired and/or wireless connections.

The controller 150 can regulate the x-rays emitted by several filaments (e.g., 1, 2, or n filaments) by selecting different drive currents ("Emitter 1 Drive," "Emitter 2 Drive," and "Emitter n Drive" in FIG. 14) and controlling the voltage sources, current sources and switches in the x-ray system to provide the corresponding drive current to the different filaments. As described above, the drive current supplied to each filament in the same x-ray system may be independently or separately controlled such that different filaments in the same x-ray system receive different drive currents.

The controller 150 may measure the current emitted by several different filaments of an x-ray system as Emission 1 Measurement 151, Emission 2 Measurement 152, and Emission n Measurement 15*n* in FIG. 14. As described herein, the current measurement devices can separately measure the currents generated by different filaments in the same x-ray system and report these measurements to the controller 150. Optionally, the controller 150 may receive an overall current measurement and a measured current for less than all of the filaments in an x-ray system, and can determine the current measurement for the other filament or filaments by determining a difference.

During exposure, the controller 150 may use a closed loop control mechanism to monitor the currents generated by the filaments and then control the current supplied to the filaments in order to independently control the filaments. The controller 150 may use this closed loop control in order to ensure that the different filaments are generating a desired ratio of tube currents, which generate x-rays when the tube currents hit the anode. The x-rays may be created in order to direct the x-rays through or into a body to be imaged, such as part of a human body or other object, so that attenuation of the x-rays can be measured in order to create an image of the body or object.

Figure 15:
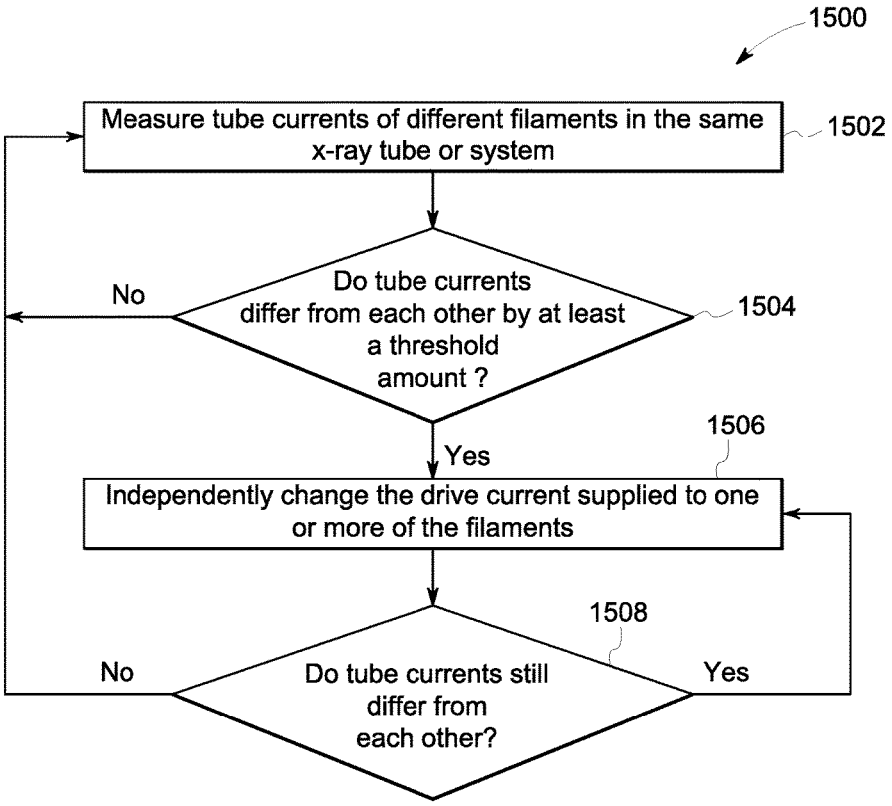
FIG. 15 illustrates a flowchart of one embodiment of a method for independently controlling several filaments of the same x-ray system or x-ray tube.

FIG. 15 illustrates a flowchart of one embodiment of a method 1500 for independently controlling several filaments of the same x-ray system or x-ray tube. The method 1500 may describe operation of the x-ray systems and/or control systems described herein, and may represent operation of an algorithm or represent the algorithm used to perform the operations described herein.

At 1502, tube currents of two or more filaments in the same x-ray system or tube are measured. As described above, the tube currents may be separately measured, or a total tube current of several filaments may be measured and the individual tube current of one or more filaments measured and subtracted from the total current to determine the tube current for one or more other filaments. At 1504, a determination is made as to whether the tube currents differ from each other. For example, the tube currents can be compared to determine if any tube current deviates from a set point (which may differ for different emitters or be the same for multiple emitters) by more than a threshold amount (which may be a threshold of zero or a non-zero threshold, such as 1%, 3%, or another value). If the tube currents vary from each other, then the drive currents supplied to one or more of the filaments may need to be modified in order to ensure that the filaments are generating the same or substantially the same x-rays. As a result, flow of the method 1500 can proceed toward 1506. Otherwise, flow of the method 1500 may return toward 1502 so that the tube currents can continue to be monitored in a closed-loop manner.

At 1506, the drive current supplied to one or more of the filaments may be independently changed. For example, if a first filament has a smaller tube current than a second filament in the same x-ray system or x-ray tube, then the drive current for the first filament may be increased while the drive current supplied to the second filament may remain the same or be reduced. At 1508, another determination is made as to whether the tube currents differ from each other. For example, after independently changing the drive current for one or more filaments, the tube currents can be measured and compared to determine if any tube current deviates from the other tube currents by more than the threshold amount. If the tube currents continue to vary from each other, then the drive currents supplied to one or more of the filaments may need to be modified in order to ensure that the filaments are generating the same or substantially the same x-rays. As a result, flow of the method 1500 can return toward 1506. Otherwise, flow of the method 1500 may return toward 1502 so that the tube currents can continue to be monitored in a closed-loop manner. For example, once the drive current for one or more filaments has been changed to cause the tube currents to be the same or substantially the same, flow of the method 1500 may return toward 1502.

In one embodiment, an x-ray system for simultaneously or concurrently measuring currents of multiple emitters is provided. The x-ray system includes a high voltage direct current (DC) supply configured to supply tube current to the multiple emitters and plural emitter circuits. Each of these circuits includes each comprising an alternating current (AC) voltage supply, at least one of the multiple emitters operatively coupled to the AC voltage supply and the high voltage DC supply, and a circuit coupling the AC voltage supply and the high voltage DC voltage supply to the at least one of the multiple filaments. At least one of the emitter circuits has a current measurement device between the high voltage DC supply and the emitter.

Optionally, each of the emitter circuits also can include a transformer coupling the AC voltage supply to the at least one of the multiple filaments. Each of the emitter circuits may also include a transformer that transforms electric current from the AC voltage supply to the at least one of the multiple filaments.

The measurement device may also be coupled to the transformer. Optionally, the high voltage DC supply potential can be used for shielding of capacitive current in the emitter circuits. Each of the emitter circuits also can include at least one of a capacitor and/or a filament drive current inductor coupling the AC voltage supply to the at least one of the multiple filaments.

Each of the emitter circuits also may include a filament inductor in parallel with the at least one of the multiple filaments. The filament inductor may have an inductance that is larger than an inductance of the filament drive current inductor. Each of the emitter circuits may also include plural filament inductors connected in series with each other and in parallel to the at least one of the multiple filaments.

The emitter circuits may include a filament drive current inductor coupling the AC voltage supply to the at least one of the multiple filaments, with each of the filament inductors having a greater inductance than the filament drive current inductor. The measurement device may be connected between the filament inductors and the high power DC voltage supply.

In one embodiment, a method includes supplying tube current from a high voltage direct current (DC) voltage supply to plural emitter circuits to cause filaments in the filament circuits to generate x-rays, supplying an alternating current (AC) for each of the emitter circuits to cause the filaments in the filament circuits to generate the x-rays, and independently measuring current for the filaments in the emitter circuits through a current measurement device disposed between the high voltage DC supply and the emitter.

Supplying the AC may include conducting the AC through a filament transformer between an AC voltage supply and at least one of the filaments. Supplying the AC may include conducting the AC through an inductor within a circuit path between an AC voltage supply and at least one of the filaments. Optionally, supplying the AC can include conducting the AC through a plurality of inductors or transformers with an AC voltage supply coupled to a middle point of the plurality of inductors or transformers. Supplying the AC may include conducting the AC through a separate filament transformer for each of the filaments.

In one embodiment, an x-ray system includes one or more alternating current (AC) power supplies configured to supply drive currents, plural filaments configured to receive the drive currents to generate x-rays, and plural current measurement devices coupled with the filaments and with a high voltage supply. The current measurement devices are configured to independently measure tube currents of each of the filaments.

The x-ray system optionally may include at least one of a transformer and/or an inductor between the one or more AC power supplies and the filaments. The current measurement devices may be disposed between the at least one of the transformer or the inductor and the high voltage supply. The x-ray system may include emitter circuits that each include one of the filaments and one of the AC power supplies, where the emitter circuits are electrically isolated from each other prior to coupling a high voltage (HV) power supply. The emitter circuits optionally may each include one of the filaments and one of the AC power supplies, where the emitter circuits are conductively coupled with each other.

As used herein, an element or step recited in the singular and proceeded with the word "a" or "an" should be understood as not excluding plural of said elements or steps, unless such exclusion is explicitly stated. Furthermore, references to "one embodiment" of the presently described subject matter are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the subject matter set forth herein without departing from its scope. While the dimensions and types of materials described herein are intended to define the parameters of the disclosed subject matter, they are by no means limiting and are exemplary embodiments. Many other embodiments will be apparent to those of skill in the art upon reviewing the above description. The scope of the subject matter described herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the subject matter set forth herein, including the best mode, and also to enable a person of ordinary skill in the art to practice the embodiments of disclosed subject matter, including making and using the devices or systems and performing the methods. The patentable scope of the subject matter described herein is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. An x-ray system for independently and simultaneously measuring currents of a plurality of emitters of an x-ray tube, the x-ray system comprising:

a high voltage direct current (DC) supply configured to supply tube current to the plurality of emitters of the x-ray tube; and a plurality of emitter circuits to power a respective one of the plurality of emitters, each emitter circuit comprising:

an alternating current (AC) voltage supply;

a circuit coupling the AC voltage supply and the high voltage DC voltage supply to the respective emitter; and a current measurement device between the high voltage DC supply and the respective emitter.

2. The x-ray system of claim 1, wherein each of the emitter circuits further comprises a transformer coupling the AC voltage supply to the respective emitter.

3. The x-ray system of claim 1, wherein each of the emitter circuits further comprises a transformer that transforms electric current from the AC voltage supply to the respective emitter.

4. The x-ray system of claim 2, wherein the measurement device also is coupled to the transformer.

5. The x-ray system of claim 1, wherein the high voltage DC supply potential is used for shielding of capacitive current in the emitter circuits.

6. The x-ray system of claim 1, wherein each of the emitter circuits further comprises at least one of a capacitor or a filament drive current inductor coupling the AC voltage supply to the respective emitter.

7. The x-ray system of claim 6, wherein each of the emitter circuits further comprises a filament inductor in parallel with the respective emitter.

8. The x-ray system of claim 7, wherein the filament inductor has an inductance that is larger than an inductance of the filament drive current inductor.

9. The x-ray system of claim 1, wherein each of the emitter circuits further comprises a plurality of filament inductors connected in series with each other and in parallel to the respective emitter.

10. The x-ray system of claim 9, wherein the emitter circuits include a filament drive current inductor coupling the AC voltage supply to the respective emitter and wherein each of the filament inductors has a greater inductance than the filament drive current inductor.

11. The x-ray system of claim 9, wherein the measurement device is connected between the filament inductors and the high power DC voltage supply.

12. A method comprising:

supplying tube current from a high voltage direct current (DC) voltage supply to a plurality of emitter circuits to cause a plurality of emitters of an x-ray tube to generate x-rays;

supplying a respective alternating current (AC) for each of the emitter circuits to cause the each respective emitter of the x-ray tube to generate the x-rays; and independently and simultaneously measuring current for each emitter of the x-ray tube through a current measurement device disposed between the high voltage DC supply and each emitter.

13. The method of claim 12, wherein supplying the AC includes conducting the AC through a filament transformer between an AC voltage supply and the emitter.

14. The method of claim 12, wherein supplying the AC includes conducting the AC through an inductor within a circuit path between an AC voltage supply and the emitter.

15. The method of claim 12, wherein supplying the AC includes conducting the AC through a plurality of inductors or transformers with an AC voltage supply coupled to a middle point of the plurality of inductors or transformers.

16. The method of claim 12, wherein supplying the AC includes conducting the AC through a separate filament transformer for each of the emitters.

17. An x-ray system comprising:

a plurality of alternating current (AC) power supplies configured to supply drive currents;

a plurality of emitters of an x-ray tube configured to receive the drive currents to generate x-rays; and a current measurement device coupled with a respective one of the plurality of emitters and with a high voltage supply, the current measurement devices configured to independently and concurrently measure tube currents of each of the emitters.

18. The x-ray system of claim 17, further comprising at least one of a transformer or an inductor between the one or more AC power supplies and the emitters.

19. The x-ray system of claim 18, wherein the current measurement devices are disposed between the at least one of the transformer or the inductor and the high voltage supply.

20. The x-ray system of claim 17, further comprising emitter circuits that each include one of the emitters and one of the AC power supplies, wherein the emitter circuits are electrically isolated from each other prior to coupling a high voltage (HV) power supply.

21. The x-ray system of claim 17, further comprising emitter circuits that each include one of the emitters and one of the AC power supplies, wherein the emitter circuits are conductively coupled with each other.

* * * * *